United States Patent [19]

Pietschmann et al.

[11] 4,421,483

[45] Dec. 20, 1983

[54] DELIVERY SYSTEM FOR DENTAL INSTRUMENTS OR THE LIKE

[75] Inventors: Helmut Pietschmann, Karlsbad; Manfred Schmidt, Karlsruhe; Emil Hirth, Malsch, all of Fed. Rep. of Germany

[73] Assignee: Sybron Corporation, Rochester, N.Y.

[21] Appl. No.: 240,486

[22] Filed: Mar. 4, 1981

[30] Foreign Application Priority Data

Apr. 10, 1980 [DE] Fed. Rep. of Germany ..... 3013882

[51] Int. Cl.[3] ..... A61G 1/14

[52] U.S. Cl. ..... 433/77

[58] Field of Search ..... 433/77, 78, 79

[56] References Cited

U.S. PATENT DOCUMENTS

| | | | |
|---|---|---|---|
| 3,143,803 | 8/1964 | Lunn | 433/77 |
| 3,530,513 | 9/1970 | Maurer et al. | 433/77 |
| 3,650,033 | 3/1972 | Behne et al. | 433/79 |
| 3,726,012 | 4/1973 | Grayson et al. | 433/79 |

*Primary Examiner*—Robert Peshock

*Attorney, Agent, or Firm*—Robert A. Gerlach; Robert J. Bird; Roger Aceto

[57] ABSTRACT

A dental unit has dental instruments carried by individual nests, the nests being selectively movable from a storage position to a readiness position. Each nest is carried to the readiness position in a controlled manner such that the axis of the instrument becomes horizontal and moves downwardly as the instrument approaches the readiness position.

1 Claim, 8 Drawing Figures

DELIVERY SYSTEM FOR DENTAL INSTRUMENTS OR THE LIKE

BACKGROUND OF THE INVENTION

The present invention relates to a dental instrument delivery system which moves the instrument between an inaccessible stored position and a ready position. At the ready position the instrument is held so it can be grasped by the dentist. More particularly, the present invention relates to a delivery system which delivers the instrument into the open hand of the dentist whereby the instrument, as it approaches the ready position travels downwardly through a substantially vertical path of travel into the open hand of the dentist as opposed to traversing in a horizontal direction across the dentist's hand.

A dental unit commonly supports a plurality of dental instruments requiring a source of utility supply, such as pneumatic and electric drills, syringes and suction equipment. In such units, it is desirable to locate the instruments side by side in an array with the smallest possible spacing between adjacent instruments so as to maintain the overall width of the unit as small as possible.

However, bunching the instruments too close together makes it difficult for the dentist to select and grasp a particular instrument. This is particularly true if the instruments are so close together that the user cannot put his hand between adjacent instruments.

The problem is solved to some extent by individually supporting instruments close together in a stored or inaccessible position. When the dentist desires to use a particular instrument, the selected instrument together with its support is moved from the array to a readiness position. At the readiness position, the selected instrument and its support stands out from the array so that it may be easily grasped by the dentist. With this arrangement, the dentist merely grasps the instrument and pulls it from its support to a point of use. After use, the dentist can return the instrument to its support for later use as desired. When the instrument is no longer needed, the instrument and its support is moved from the readiness position back to the storage position.

In one delivery system as shown, for example, in German Pat. No. 29,876 the instrument stored within the unit is pushed into the readiness position by an ejection spring operated by pressure on a slide bar, the bar also acting as the means for selecting the particular instrument desired. When the procedure is complete, the instrument is returned by pushing on the slide bar to move the instrument and its nest against the force of the ejection spring toward the stored position.

U.S. Pat. No. 3,802,736 provides a system wherein the instrument is returned to its stored position under the restoring bias of a spring acting on the instrument feedline. In this situation, however, the bias of the spring operates on the feedline while it is being drawn out to its full length. Thus, the user must overcome this bias when moving the instrument nest to a readiness position and when withdrawing the instrument from its nest.

SUMMARY OF THE INVENTION

The problem, then, overcome by the present invention is to effectively decrease the handling area for the movement of a dental instrument between an inaccessible storage position and a readiness position while simultaneously avoiding obstacles which interfere with the handling of a instrument, such as the proximity of the selected instruments from an adjacent instrument.

The present invention in one embodiment, also allows handling of the dental instruments in a manner which delivers any selected instrument and its support nest to substantially the same concentrated handling area or readiness position thereby providing a space saving accommodation of the instrument in or on the dental unit. In this respect a plurality of instruments can be stored out-of-the-way in an inaccessible position and then selectively brought to generally the same readiness position within easy reach of the dentist.

As a further advantage, the present invention provides a dental unit which is able to transfer a selected instrument from the dental unit to the dentist in a manner which simulates the natural "handing over" process of the instrument from the hand of an assistant to the hand of the dentist. Such "handing over" process was previously achieved only manually as for example, in the case of the assistant placing the instrument in the hand of the dentist which is being held in a position to receive the instrument from the assistant. According to such a "handing over" process, the apparatus of the present invention presents the selected instrument into the hand of the dentist without a noticeable tangential movement of the instrument with respect to the plane of the hand held in the position to receive the instrument.

DESCRIPTION OF THE PREFERRED EMBODIMENTS

Figure 1:
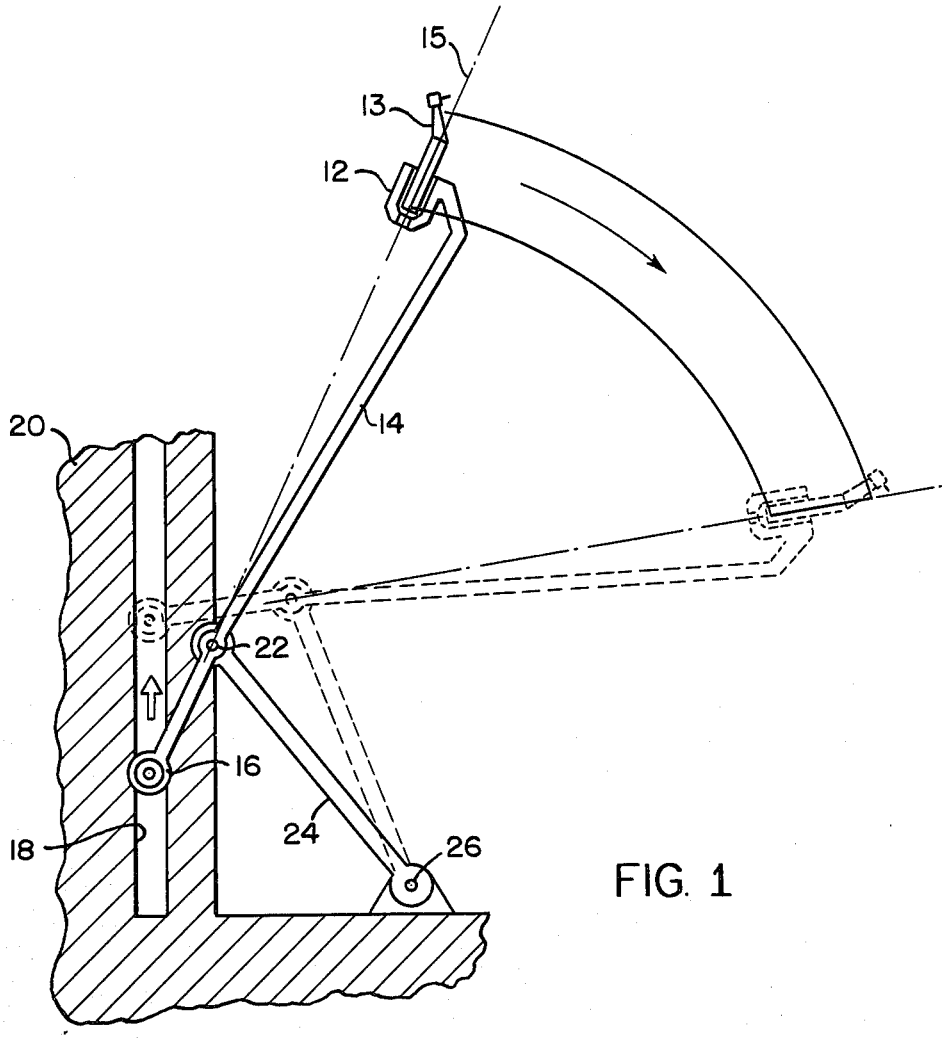
FIG. 1 shows schematically the movement of a dental instrument and its supporting nest from a rest or stored position to a readiness position.

The embodiment as shown in FIG. 1 illustrates a mechanism for delivering an individual dental instrument and its supporting nest from a storage position to a readiness position wherein the instrument, as it approaches the readiness position (shown in dotted line), travels downward in a generally vertical direction.

In this respect, an instrument holder or nest 12, as shown in FIG. 1, is mounted on one end of a swivel arm 14. The other end 16 of the swivel arm is slidably captured in a generally vertical groove 18 formed in a wall 20 of the dental unit. Intermediate its ends, swivel arm 14 is journaled at 22 to one end of a link 24. The other end of link 24 is pivoted to a fixed point 26 spaced outwardly from slot 18. With this arrangement, movement of the swivel arm end 16 upwards in slot 18 acts to move the instrument nest downward and to the right as shown in FIG. 1. The instrument 13 is held by the nest so that the axis 15 of the instrument extends through journal 22 and the instrument itself forms generally an extension of swivel arm 14. Thus, the axis 15 of the instrument becomes generally horizontally oriented and moves downward as the instrument approaches the readiness position.

The solid line position, as shown in FIG. 1 is the stored or inaccessible position of the instrument and the dotted line position represents the readiness position. Assume the dentist has his hand, palm up, at the readiness position awaiting the arrival of the instrument.

It should be appreciated that when the instrument first moves, it travels outward and downward toward the readiness position. However, as the instrument nears the readiness position and the dentist's hand, there is only a vertical component of motion and there is no component of motion across the plane of the dentist's hand. The arrangement as illustrated thus functions to lay the instrument in the open hand of the dentist and simulates the function of nurse or assistant presenting the instrument to the dentist. Once the instrument is laid in the dentist's hand, he simply grasps the instrument and pulls it from the nest to a point of use. Since the instrument was delivered to the readiness position by swivel arm 14, there is no spring or rewind force to resist the dentist as he pulls the instrument from the nest or returns it to the nest.

Figure 2:
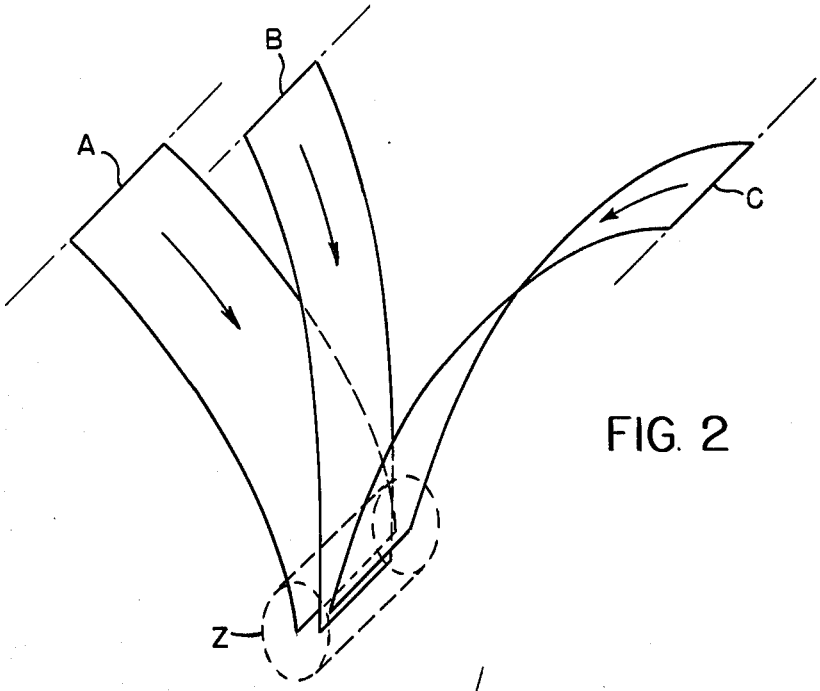
FIGS. 2 and 3 show schematically, methods of selection whereby instruments located at various spaced apart rest positions are selectively moved through planes of travel to a single readiness position.

FIGS. 2–5 illustrate embodiments wherein instruments, which are stored in various spaced apart positions, may be independently carried to the same readiness position. In such an arrangement, then, the dentist would not have to search an array of instruments for the selected one but instead, each of the selected instruments would be brought to the same readiness position. For example, in FIG. 2, the letters A, B and C represent the axis of each of three instruments at a rest or stored position. The instruments, whose axes are represented by the letters A, B and C are spaced apart and normally inaccessible when at the stored position. Each instrument would be selectively movable to a readiness position. In moving to the readiness position, in the direction represented by the arrows, each instrument follows a curved path of travel wherein the axis of each instrument traverses a path which converges on the same readiness position. Accordingly, even though the instruments may be stored at different inaccessible positions, any one of the selected instruments may be brought to approximately the same readiness position as represented in FIG. 2 by the volume or space enclosed by dotted line Z.

Figure 3:
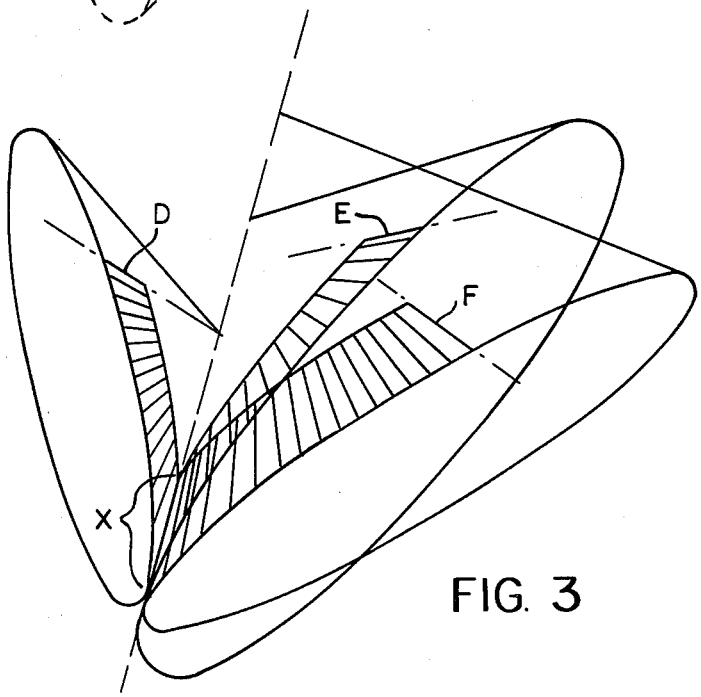

Another arrangement for bringing one of several instruments to the same readiness position is schematically illustrated in FIG. 3. Here, the axes D, E and F respectively of the dental instruments traverse loci of revolution which are sections of conical surfaces. These loci are coincident along a line identified at X and where the axes become coincident is the readiness position. With this arrangement each instrument when moved from the stored position traverses a plane which is a conical surface as shown so that the same readiness position "X" can be reached from any one of several stored positions.

It should should be noted that in both FIGS. 2 and 3 the readiness position is approached with only a vertical component of motion so these arrangements will lay the instrument in the waiting hand of the dentist as described hereinabove in connection with the FIG. 1 embodiment.

Figure 4:
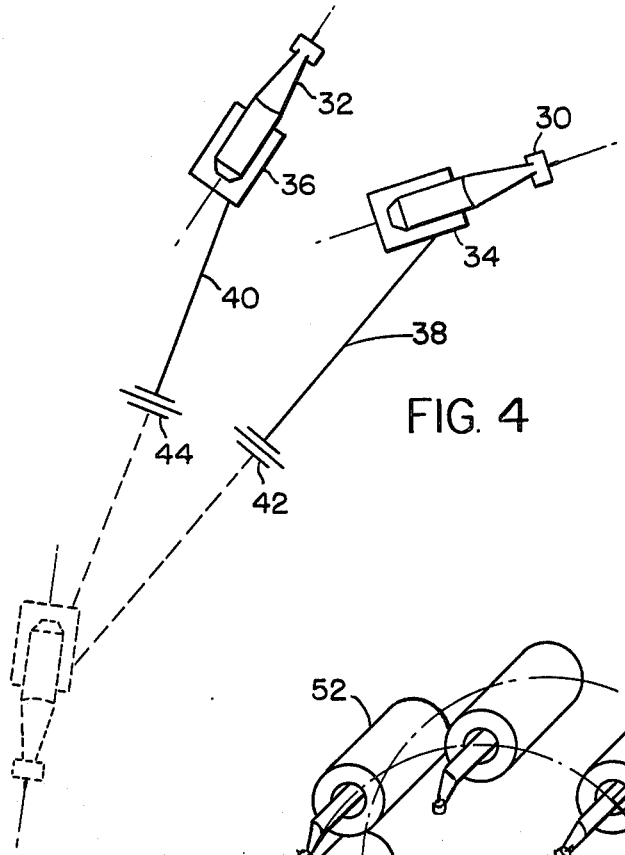
FIG. 4 is a schematic representation of an embodiment of the invention wherein two instruments and nests stored at different rest positions as shown in solid line can be moved independently to the same readiness position shown in dotted line.

A device for implementing the arrangement of FIG. 3 is shown in FIG. 4. In FIG. 4, two instruments 30 and 32 shown in solid line are in the stored or rest position which, for example, could be within a dental unit. These instruments are carried by nests 34 and 36 respectively. Each nest is mounted on one end of a swivel arm 38, 40 the journal or pivoting point for each arm being identified at 42, 44 respectively. Each nest 34, 36 holds its associated instrument 30, 32 at an angle with respect to swivel arms 38, 40. This angle is selected so that the axis of the instrument when rotated about the journal 42 or 44 will generate a conical surface. Moreover, the journals 42 and 44 are angled with respect to each other so that the conical surfaces generated by the axis of each instrument will be coincident when the instruments are rotated to the point shown in dotted line which is the readiness position. Accordingly, with this arrangement, any one of the selected instruments 30, 32 (or others) can be rotated from the stored position shown in solid line to the same readiness position shown in dotted line.

Figure 5:
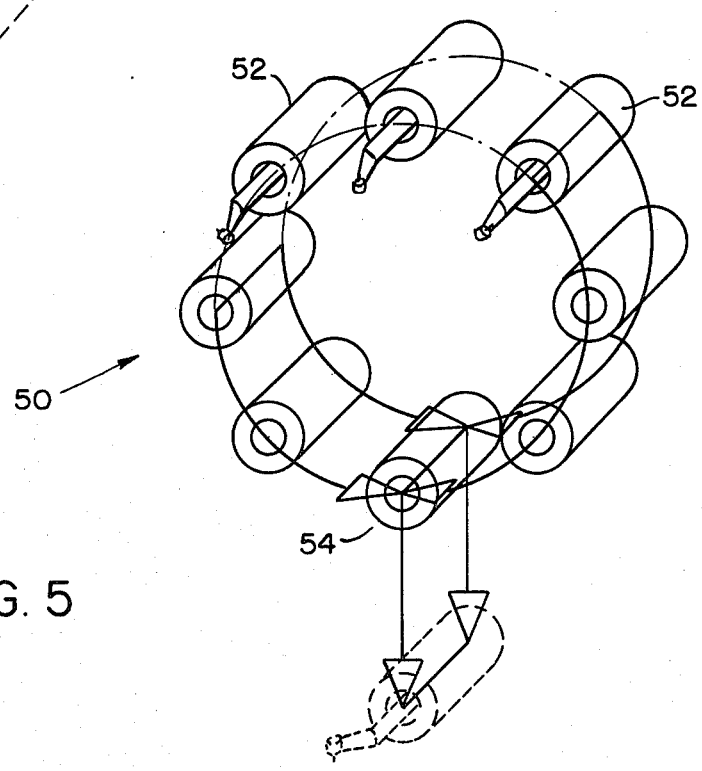
FIG. 5 is a schematic representation wherein a plurality of instruments are carried on a revolving turret for movement between a stored position to an intermediate position and thereafter to the readiness position.

In FIG. 5 a turret arrangement of instrument nests is generally indicated at 50. Each nest 52 supports one instrument at some stored position within the dental unit. With this arrangement, the turret can be rotated by suitable means (not shown) to bring the nest holding a selected instrument to an intermediate position as represented for example by the reference 54. From this intermediate position, the nest is then lowered or otherwise transported to the readiness position illustrated in dotted line.

Thus, in each of the embodiments, as shown in FIGS. 2–5, the dental instrument is moved from a stored position through a path of travel to a readiness position, each of the instruments being moved from different stored positions to the same readiness position. Also, in the embodiments shown in FIGS. 2–5, the component of motion as the instrument nears the readiness position is a vertical component so that the instrument may be delivered downwardly directly into the open waiting hand of the dentist.

Figure 6:
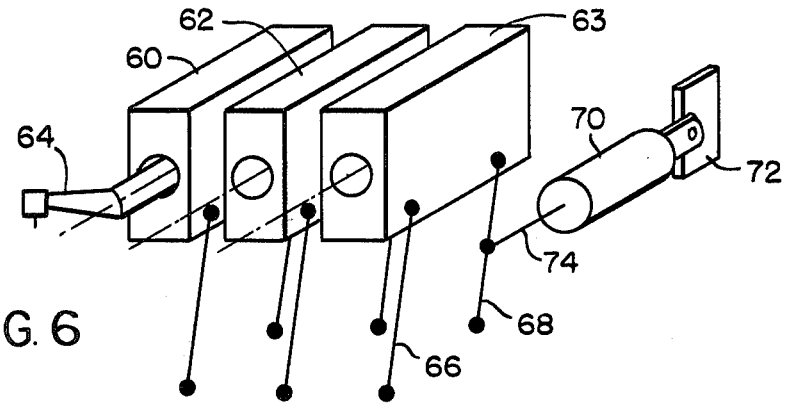
FIGS. 6 and 7 are perspective and side elevation views respectively of an embodiment wherein the individual nests are mounted on a parallel motion link for movement between a stored and a readiness position.
Figure 7:
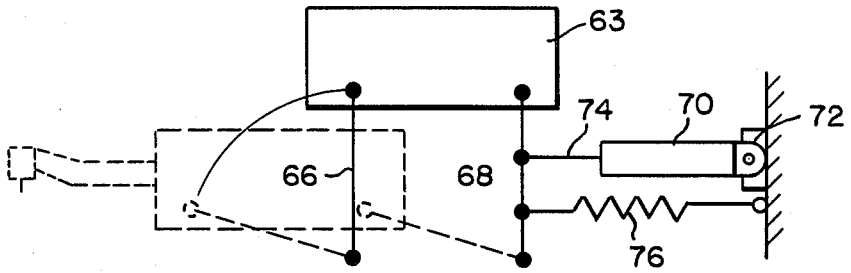

FIGS. 6 and 7 show still another embodiment of the invention. Here three nests 60, 62 and 63 are packed closely together side by side in a dental unit. It should be appreciated that each nest holds a dental instrument such as the hand piece shown at 64. The utility line delivering service to the dental instruments held by the nests extends out through the back of each nest to a rewind reel or other suitable retraction mechanism (not shown) contained within the dental unit. The nest itself holds or supports an individual instrument and is part of the mechanism for delivering a selected instrument from a storage position to a readiness position.

Each nest is supported on a parallel motion linkage as represented, for example, by arms 66 and 68, it being understood that the arms are pivoted at one end to the nest and at the other end to the body of the dental unit or console (not shown).

Since the nests are packed closely together the instruments are relatively inaccessible because it would be difficult, if not impossible, for the dentist to simply select one instrument 64 and pull it from the nest. In this regard, the dentist may not be able to put his hand between adjacent instruments to grasp and pull the selected instrument from its associated nest or the nests may be remotely located within the unit. Accordingly, in the embodiment as shown in FIG. 6, any suitable drive means, such as a hydraulic or pneumatic cylinder 70 is associated with each nest (only one such cylinder being shown). One end 72 of the cylinder is fixed to the dental unit and the drive member 74 of the cylinder is attached to a parallel motion linkage. With this arrangement, operation of the cylinder will drive the parallel motion linkage to move the selected nest 60, 62 or 63 forward or to the left as viewed in the figures to the dotted line position shown in FIG. 7. Here the selected nest is spaced outwardly from the rest of the array so the instrument it carries can be grasped by the dentist.

When moving from the rest of the array, the selected nest 60, 62 or 63 traverses a generally arcuate path of travel as shown in FIG. 7 forward and downward from the instrument array. As the nest approaches the readiness position, the instrument is traveling generally in a vertical direction so that this embodiment, as those described hereinabove, simulates a movement wherein the instrument is placed downwardly into the waiting hand of the dentist without any transverse component of motion across the dentist's hand.

The hydraulic or pneumatic piston 70 may be used both for moving the nest to the readiness position and for retracting the nest back into the stored position within the dental unit. It is also desirable to allow the piston to function as a damping means so that as the selected nest approaches the readiness position, as shown in dotted line in FIG. 7, the velocity of the nest is slowed to zero. This prevents the dental instrument from being prematurely ejected from the nest due to any sudden stop of the nest. If desired, a spring as illustrated at 76, in FIG. 7 can be provided for retracting the nest after the dentist has returned the instrument to the nest.

Figure 8:
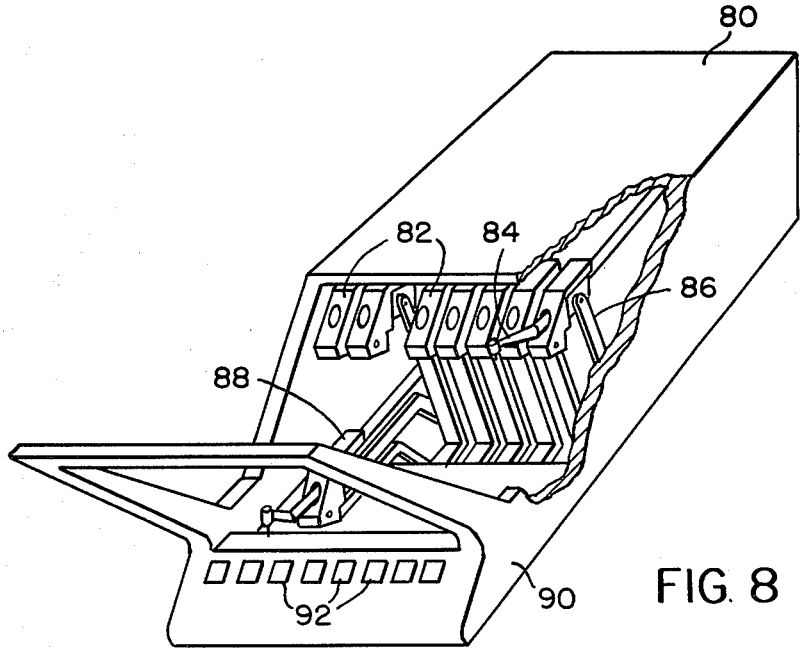
FIG. 8 shows a dental unit including means for initiating delivery of a selected instrument.

In FIG. 8 a complete dental unit is shown incorporating the delivery system illustrated in FIGS. 6 and 7. In FIG. 8, the dental unit 80 is shown to consist generally of an elongated housing, the various instrument nests 82 are disposed within the housing, each nest supporting one dental instrument 84 and each nest being supported by a parallel motion linkage 86 as described hereinabove. The means for moving the individual nests from the stored position, such as the hydraulic or pneumatic cylinder 70 of FIGS. 6 and 7, are not shown. However, they would be in the dental unit 80 behind the individual nests.

It can be appreciated that the nests are packed or bunched close together so that the distance across the array of nests is relatively small. One nest 88 is shown displaced from the array and in the readiness position.

A portion of the unit identified at 90 extends forward and below the readiness position. Carried by this portion of the dental unit is an array of switching elements 92, each switching element corresponding to one of the nests 82. These switching elements could be any appropriate short stroke switch or sensor key which is touched to activate the delivery system. Preferably the selector keys 92 are located directly under the readiness position of the instruments. With this arrangement, the dentist can simply reach back, touch the appropriate switch and open his hand, palm up, to await the delivery of the selected instrument. Accordingly, there is no appreciable movement of the dentist's hand between the point where the instrument is selected and the point where the instrument is delivered into the dentist's hand.

A return of the nest from the readiness position to the stored position can be accomplished by any suitable means such as second pushing of the appropriate switch 92 or by a contact (not shown) made when the instrument is returned into its nest.

Thus, the present invention provides an instrument delivery system which has several desirable features. First, in all embodiments a selected instrument can be moved from a remote or inaccessible storage position to a readiness position convenient to the dentist. In one aspect the inaccessibility of the instruments may be due to the fact that they are bunched or packed so close together in a side-by-side array that the dentist cannot reach between adjacent instruments to grasp the selected one.

Secondly, the delivery system of the present invention functions to lay the selected instrument into the hand of the dentist simulating the motion of an assistant. The movement of the instrument as it approaches the readiness position is downward with little or no horizontal component of motion. Thus, the dentist can simply hold his hand, palm up, at the readiness position and the system will deliver the instrument by laying it in the dentist's hand.

In another embodiment of the invention each instrument may be selectively delivered to generally the same readiness position. In this case the dentist need not move his hand along an array to select the instrument. Instead the dentist simply holds his hand at one readiness position and each instrument is selectively delivered from remote points to that one readiness position. The drawback here is that each selected instrument must be moved from the readiness position either back to a stored position or to some intermediate holding position before another selected instrument can be moved to the readiness position.

Having thus described the invention in detail, what is claimed as new is:

1. In a dental unit having a plurality of nests, each nest releasably supporting a dental treatment instrument and being movable between a stored position and a readiness position, the improvement comprising:

(a) a movable support mechanism connecting each of said nests to the dental unit for moving said nest and dental instrument through an arcuate path of travel between said storage and readiness positions, each said mechanism including an elongated swivel arm connected at one end thereof to a nest and pivoted at the other end thereof for rotational movement by which said nest is moved through said arcuate path, said mechanism acting to control the orientation of said nest such that the axis of said instrument assumes a generally horizontal attitude and said path of travel assumes a generally downward direction as said readiness position is approached; and (b) selection means operatively connected to said movable support mechanism for initiating movement of a selected nest towards said readiness position, said selection means being located on said dental unit beneath said readiness position, wherein said support mechanism is further defined as:

(i) said elongated swivel arm having one end slidably captured in a vertical groove formed in a wall of said unit and a free end;

(ii) said instrument nest on said free end arranged to hold an instrument such that said instrument forms an extension of said swing arm with the axis of said instrument extending in generally the same direction as said arm;

(iii) a link having one end pivoted to said unit and a second end journaled to said swivel arm intermediate the ends thereof; and (iv) said swivel arm being oriented in a generally upright position when said nest is in a stored position and said captured end moving vertically upward in said groove as said nest is brought to a readiness position.

* * * * *